US010711800B2

(12) United States Patent
Boguta et al.

(10) Patent No.: US 10,711,800 B2
(45) Date of Patent: Jul. 14, 2020

(54) TURBO COMPRESSOR SUPPORTED ONLY BY ITS INLET AND OUTLET FLANGES

(71) Applicant: Howden Turbo GmbH, Frankenthal (DE)

(72) Inventors: Tomasz Kamil Boguta, Søborg (DK); Claus Smits Hansen, Påarp (SE); Joergen Lyquist, Alsgarde (DK)

(73) Assignee: Howden Turbo GmbH, Frankenthal (DE)

( * ) Notice: Subject to any disclaimer, the term of this patent is extended or adjusted under 35 U.S.C. 154(b) by 0 days.

(21) Appl. No.: 15/960,597

(22) Filed: Apr. 24, 2018

(65) Prior Publication Data

US 2018/0306205 A1 Oct. 25, 2018

Related U.S. Application Data

(63) Continuation of application No. PCT/EP2016/074862, filed on Oct. 17, 2016.

(30) Foreign Application Priority Data

Nov. 3, 2015 (EP) ..... 15192797

(51) Int. Cl.
*F04D 29/60* (2006.01)
*F04D 29/42* (2006.01)
(Continued)

(52) U.S. Cl.
CPC ..... *F04D 29/601* (2013.01); *F02M 26/34* (2016.02); *F04D 29/4206* (2013.01);
(Continued)

(58) Field of Classification Search
CPC ..... F04D 29/4206; F04D 29/4213; F04D 29/4233; F04D 29/601; F02M 26/34
See application file for complete search history.

(56) References Cited

U.S. PATENT DOCUMENTS 3,447,740 A * 6/1969 Friberg ..... F04D 19/02 415/181
4,687,412 A * 8/1987 Chamberlain ..... F04D 29/4206 415/134
(Continued)

FOREIGN PATENT DOCUMENTS

CN 2433438 Y 6/2001
CN 201236840 Y 5/2009
(Continued)

OTHER PUBLICATIONS

International Search Report and Written Opinion of PCT/EP2016/074862 dated Jan. 20, 2017.
(Continued)

*Primary Examiner* — Woody A Lee, Jr.
(74) *Attorney, Agent, or Firm* — Edell, Shapiro & Finnan, LLC

(57) ABSTRACT

The invention concerns a radial turbo compressor (TCO) including at least one impeller (IP) at least one casing (CS), the impeller (IP) is rotatable about an axis (X), the casing (CS) comprises an inlet (IL) upstream of the impeller (IP), the inlet (IL) comprising an inlet flange (IF) to be mounted to a process gas pipe (PGP), the casing (CS) comprises an outlet (OL) down-stream of the impeller (IP) comprising an outlet flange (OF), the casing (CS) comprises an outlet volute (VL) extending about the axis (X) downstream of the impeller (IP) and upstream of the outlet (OL), and the radial turbo compressor (TCO) comprises a drive unit (DRU) driving the impeller (IP) and being mounted to the casing (CS). In order to simplify exhaust gas quality improvement the invention proposes that the casing (CS) is exclusively supported by the inlet flange (IF) and the outlet flange (OF), the casing (CS) comprises a drive unit flange (DRF), the drive unit (DRU) comprises a fixation flange (FF), the drive unit flange (DRF) and the fixation flange (FF) are fixedly
(Continued)

connected to each other by fixation elements (FE), the drive unit (DRU) being exclusively supported by the fixation flange (FF). Further, the invention deals with an arrangement (AR) comprising such a turbo compressor (TCO).

18 Claims, 6 Drawing Sheets

(51) Int. Cl.
*F02M 26/34* (2016.01)
*F04D 29/66* (2006.01)
*F04D 29/68* (2006.01)

(52) U.S. Cl.
CPC ..... *F04D 29/4213* (2013.01); *F04D 29/4233* (2013.01); *F04D 29/668* (2013.01); *F04D 29/685* (2013.01)

(56) References Cited

U.S. PATENT DOCUMENTS

2004/0112344 A1 6/2004 Wark et al.
2014/0178183 A1* 6/2014 Masuda ..... F04D 29/4206 415/173.1
2016/0146220 A1* 5/2016 Chaggar ..... F04D 29/624 415/119
2016/0186779 A1* 6/2016 Cooley ..... F04D 29/4206 415/177

FOREIGN PATENT DOCUMENTS

CN 102269083 A 12/2011
CN 104963894 A 10/2015
EP 2924261 A1 9/2015
FR 955138 A 1/1950
GB 798477 A * 6/1955 ..... F04D 29/4206
JP 2011112006 A 6/2011
JP 2013503291 A 1/2013
WO 2015008733 A1 1/2015

OTHER PUBLICATIONS

International Preliminary Report on Patentability for PCT/EP2016/074862 dated Oct. 18, 2017.
Chinese Office Action in corresponding Chinese Patent Application No. 201680062341.9, dated Aug. 16, 2019, 16 pages with English Translation.
Notice of Preliminary Rejection for Korean Patent Application No. 10-2018-7015460, dated Sep. 20, 2019, with English Translation, 14 pages.

* cited by examiner

TURBO COMPRESSOR SUPPORTED ONLY BY ITS INLET AND OUTLET FLANGES

CROSS-REFERENCE TO RELATED APPLICATIONS

This is a Continuation of PCT/EP2016/074862 filed on Oct. 17, 2016, which PCT claims the benefit of European Priority Application No.: 15192797.7 filed on Nov. 3, 2015, both of which are incorporated by reference herein in their entirety.

FIELD OF THE DISCLOSURE

The invention concerns an arrangement comprising a piston engine, comprising an exhaust gas line for exhaust gas, comprising a recirculation line conducting a portion of said exhaust gas into an inlet of said piston engine, wherein a radial turbo compressor is provided in said recirculation line, wherein the radial turbo compressor comprises: at least one impeller, at least one casing, wherein said impeller is rotatable about an axis, wherein said casing comprises an inlet upstream said impeller, comprising an inlet flange to be mounted to a process gas pipe, wherein said casing comprises an outlet downstream said impeller comprising an outlet flange, wherein said casing comprises a outlet volute extending about said axis downstream said impeller and upstream said outlet, wherein said radial turbo compressor comprises a drive unit driving said impeller and being mounted to said casing. Further the invention refers to an arrangement comprising said turbo compressor.

SUMMARY AND BACKGROUND OF THE DISCLOSURE

Radial turbo compressors of the incipiently mentioned type are used in a wide variety of applications for compressing gas. The radial turbo compressor type is suitable for low pressure operation as well as for high pressure compression. The invention does not distinguish between a fan and a compressor regarding the pressure range. The compressor according to the invention is applicable in low pressure head operation as well. Specific advantages of the radial turbo compressor type are a high robustness and a high flexibility regarding volume flow and pressure difference.

Document FR 955 138 A discloses some aspects of the invention but does not consider exhaust gas recirculation. Some aspects of the invention are also shown in EP 2 924 261 A1.

Since radial turbo compressors normally are built bigger and heavier for the same volume flow capacity than axial flow compressors the axial machine type might be preferred for applications with limited space consumption requirements. Radial type machines tend to be more flexible and robust. Limited room availability not only restricts the final space requirement during operation of a machine but in most cases the assembly and maintenance is decisive regarding their feasibility with the available space.

It is therefore one object of the invention to provide an arrangement including a turbo compressor unit requiring less space during assembly and operation. This object is achieved by an incipiently mentioned type of an arrangement comprising the additional feature of the respective claim referring to such a component, wherein dependent claims refer to preferred embodiments of the invention.

The radial turbo compressor according to the invention comprises at least one impeller but can comprise several impellers as well. Preferably the impeller(s) is(are) mounted to a shaft. Preferably the shaft is supported by drive unit internal bearings exclusively. The drive unit is preferably provided as an electric motor.

Between the impeller and the inner components of the drive unit a shaft seal is preferably sealing the gap between the rotor shaft carrying the impeller and the stator of the motor and/or the stationary components of the casing of the turbo compressor.

An alternative preferred embodiment provides that the drive unit is connected in a gas tight or hermetically sealed manner to the turbo compressor casing. A drive unit casing is gas tight and the process gas delivered by the radial turbo compressor is floating into the drive unit casing.

In case, the process gas of the application intended is chemically aggressive the solution with the shaft sealing between the drive unit and the radial turbo compressor is preferred, for example in case the process gas is exhaust gas from a combustion engine.

According to the invention the turbo compressor is exclusively supported by the flange connections of the inlet flange and the outlet flange. This feature is to be understood that these flange connections are suitably build to transmit at least 95% of the mechanical load of supporting the turbo compressor against gravity as well as of supporting the turbo compressor against dynamic load from its own operation and from adjacent system excitation like pressure pulsations and vibration. The turbo compressor might be connected by other lines and pipes to allow supply of energy and maybe fluids for lubricating or cooling, but these connections don't transmit significant amounts of mechanical support load to keep the turbo compressor in its position. Since the support load is transmitted by means of the flanges to any adjacent structure like the inlet pipe of the turbo compressor the turbo compressor casing to which the flanges belong, is designed to transmit the mechanical forces of static and dynamic load to the connection flange of the adjacent module.

One preferred embodiment of the invention provides that the major part of the mechanical load to support the turbo compressor is transmitted via the inlet flange. Preferably the inlet flange is designed to carry at least 95%, preferably 100% of the dynamic and static mechanical load to the module the inlet flange is connected to by fixation elements.

A preferred embodiment of an arrangement comprising turbo compressor comprises an outlet pipe connected to the outlet flange of the turbo compressor comprising an elastic structure. This elastic structure preferably is designed to transmit low force via the outlet pipe. Alternatively the elastic structure can be embodied by the outlet pipe design and its support structure being made flexible such that mechanical load is not transmitted through this structure in a significant amount.

Another preferred embodiment of the invention provides that said casing comprises ribs in order to increase the bending stiffness of said casing, wherein said ribs distributed along the circumference of said casing extend radially at least partly between said drive unit flange and said inlet flange and extending in a radial direction along a rib's height. This rib structure enables the casing to transmit all mechanical dynamic and static loads originating from gravity and from dynamic excitation of the turbo compressor via the inlet flange of the casing into any adjacent module. These ribs provide sufficient stiffness to cope with supporting the mass of the drive unit being by said inlet flange, wherein the distance between the inlet flange and the center of gravity of the drive unit acts like a lever. The casing's preferred position in operation is a horizontal alignment of the axis (rotational axis), wherein the term 'horizontal' refers to the direction of gravity.

In order to further decrease space requirements of the turbo compressor according to the invention a preferred embodiment provides that said volute respectively a radial cross section area of said volute at each circumferential rib position is at least partly an integrated part of the respective rib at the specific circumferential position.

A further preferred refinement of this preferred embodiment provides that said casing of the turbo compressor comprises a circumferential outer first surface in an area which is not axially occupied by said outlet volute, wherein said outlet volute radially extends at least along 50% of the circumference with its radial cross section area in the same cylindrical plane as the radial outer first surface. This way the cross section area of the volute shares the same radial space with the cylindrical plane of the first radial outer surface. Since the radial cross section area of the volute is defined by an inner surface of a volute wall of specific thickness, the volute wall acts like a continuation of the ribs improving the stiffness against bending of the casing. Further this design safes radial space occupied by the turbo compressor enabling optimized aerodynamic design under restricted space availability.

Another preferred embodiment of the invention provides that said casing is casted in one piece comprising said inlet, said inlet flange, said outlet, said outlet flange, said outlet volute, said ribs, said radial outer first surface.

At least some of these ribs form together with the radial outer wall of said outlet volute a stiffening structure on the radial outer surface of the casing. Preferably this structure is in particular built to increase bending stiffness.

Another preferred embodiment provides that the casing comprises between 6 to 10 ribs, preferably 8 ribs, each extending axially and in the radial direction along a rib's height and at least some of these ribs comprise said outlet volute as an integral part with said outlet volute wall.

Another preferred embodiment provides that said casing is casted in stainless steel, wherein the preferred material is W 1.4408 (DIN: GX5 CrNiMo 19 11 2; ASTM: 316 A 743 CF-8M; this is a full austenitic Chromium-Nickel-Molibdaen-steal having good corrosion resistance). Casting the casing in stainless steel in one piece has the significant advantage that subsequent machining amounts to a minimum and is significantly less that if the casing would comprise several modules to be connected to each other.

The preferred embodiment of the casing provides the outlet volute to be semi external semi internal. As described and defined before the volute therefore has a radial cross section area. This cross section area is at least along 50%—preferably along 100% —of the circumference sectioned by a virtual cylindrical plane being defined by closely enwrapping—respectively tangenting—the radial outer surface of the casing omitting the ribs—respectively in the area which is not occupied by the ribs.

Another preferred embodiment provides an inlet chamber of the casing adjacent to the inlet flange being designed such that a sloped surface with regard to the axis respectively provides a safe drainage of any liquid collected in the inlet chamber into drain hold to avoid any liquid collection in the inlet chamber.

Another preferred embodiment of the invention is that the turbo compressor is part of an arrangement together with a pipe for a process gas or a recirculation line, wherein the recirculation line comprises a connection flange to which the inlet flange of the turbo compressor is fixedly connected to in order to transmit mechanical load from the turbo compressor to the recirculation line.

According to another preferred embodiment of the invention this arrangement further comprises a piston engine comprising an exhaust gas line for exhaust gas joining into said recirculation line conducting a portion of said exhaust gas into the turbo compressor. A further refinement of this arrangement according to the invention provides that the recirculation line is continued downstream the turbo compressor back into the piston engine for recirculation of a portion of the exhaust gas generated by said piston engine.

The preferred application of this invention is the recirculation of exhaust gas generated by a piston vessel engine to improve exhaust gas quality.

The invention further provides a method to retrofit a piston vessel engine by adding a turbo compressor according to the invention into a recirculation line or by adding a recirculation line comprising the turbo compressor according to the invention to a piston engine.

BRIEF DESCRIPTION OF THE DRAWINGS

The above mentioned attributes and other features and advantages of this invention and the manner of attaining them will become more apparent and the invention itself will be better understood by reference to the following description of the currently best mode of carrying out the invention taken in conjunction with the accompanying drawings, wherein:

In FIGS. 1-7 same reference signs are used for same components. Expressions like circumferential, radial, tangential, axial refer to the axis X of the turbo compressor TCO if not indicated otherwise.

DETAILED DESCRIPTION

Figure 1:
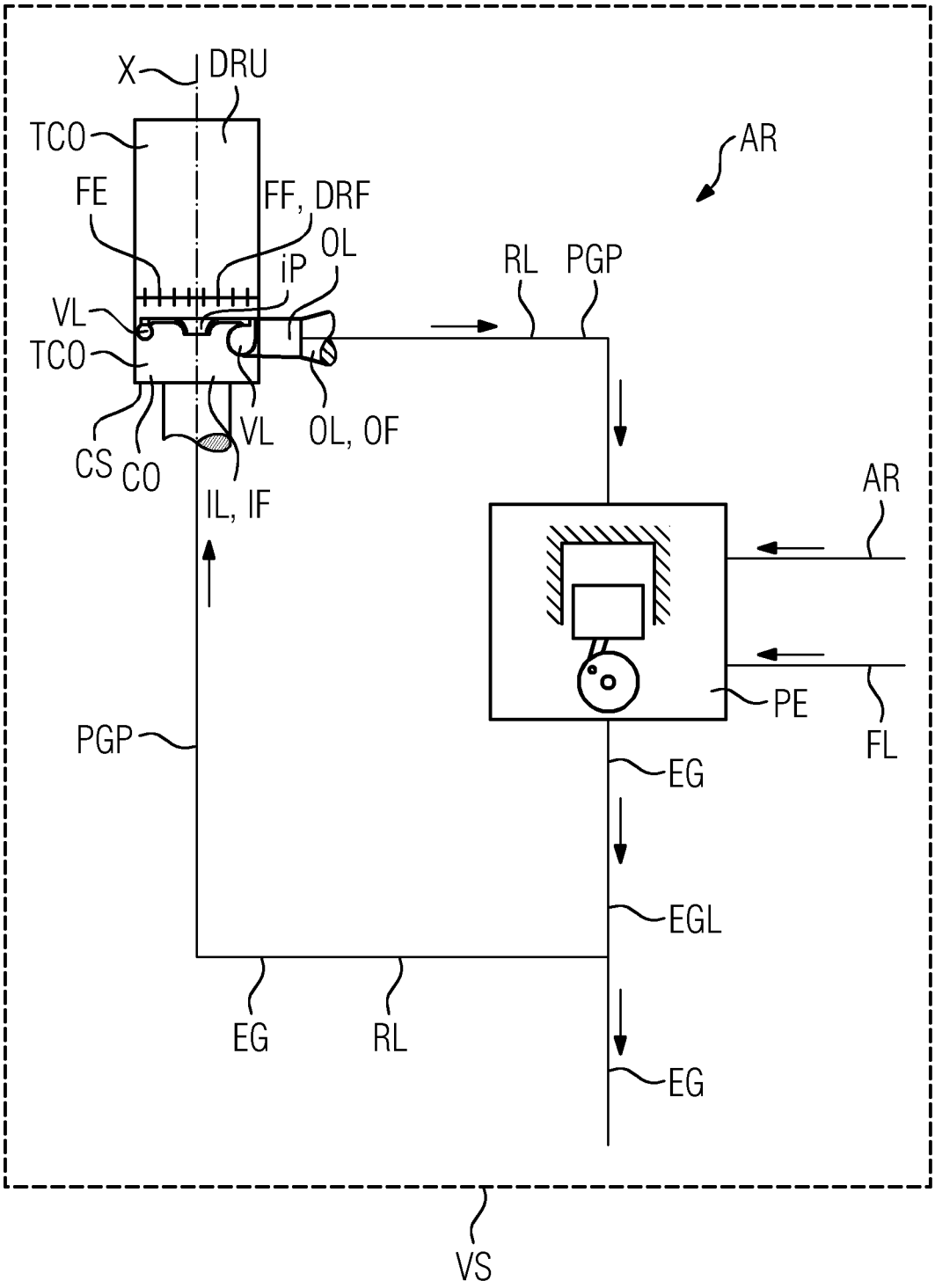
FIG. 1 shows a schematic flow diagram of a turbo compressor according to the invention being part of an arrangement according to the invention.

FIG. 1 shows a schematic depiction of an arrangement AR comprising a turbo compressor TCO according to the invention being provided in a recirculation line RL in order to deliver recirculated exhaust gas from a piston engine PE up to a higher pressure. The specific example refers to the preferred application of the piston engine belonging to a vessel VS, respectively ship. The piston engine might drive the vessel or might be used for generation of electrical energy in combination with a generator (not shown).

The piston engine PE consumes air AR and fuel FL in an internal combustion process generating exhaust gas EG and mechanical power not illustrated. The exhaust gas EG is exhausted through an exhaust gas line EGL. A portion of the exhaust gas EG is conducted into a recirculation line RL. Since the air AR is to be mixed in the piston engine PE with the recirculated exhaust gas EG from the recirculation line RL the turbo compressor TCO is used to increase the pressure of the exhaust gas EG up to the pressure of the air AR, which is compressed by a not illustrated turbo charger up to a feeding pressure for the piston engine. Recirculating exhaust gas EG as shown in FIG. 1 might improve exhaust gas quality, in particular regarding NOX-emissions.

The arrangement AR shown in FIG. 1 is part of a combustion engine for propelling a vessel. Since space on a vessel is restricted the arrangement AR comprising a recirculation line and the turbo compressor TCO needs to be small and the assembly should not require much space. Further in cases of a retrofit in order to equip an existing piston vessel engine with the arrangement comprising said recirculation line and the turbo compressor TCO according to the invention the space availability and assembly options might even be more restricted. If the piston engine PE is not originally designed including the recirculation line RL and the turbo compressor TCO the piston engine PE doesn't have any support provision for these additional components. Accordingly the invention provides an arrangement and a turbo compressor TCO to cope with these requirements by providing said turbo compressor TCO being a radial turbo compressor TCO, comprising at least one impeller IP at least one casing seal S, wherein said impeller IP is rotatable about an axis X and wherein a said casing CS comprises an inlet IL upstream said impeller IP.

An inlet flange IF of said inlet IL is to be mounted to said process gas type PGP in FIG. 1 also indicated as a recirculation line RL conducting exhaust gas EG. Said casing CS comprises an outlet OL downstream said impeller IP which outlet OL comprises an outlet flange OF. The inlet flange IF and the outlet flange OF are respectively mounted to respective flanges of the recirculation line RL respectively the process gas pipe PGP. As part of the casing CS an outlet volute VL is provided extending about said axis X downstream said impeller IP and upstream said outlet OL. This volute VL decelerates and collects the compressed exhaust gas EG to increase the pressure.

Casing CS is exclusively supported by said inlet flange IF and said outlet flange OF. Basically the inlet flange IF and the casing itself CS is build to transmit the total mechanical load via the inlet flange IF preferably to the process gas pipe PGP flange respectively the recirculation line RL flange. The recirculation line downstream the turbo compressor TCO doesn't carry any load from the support of the turbo compressor TCO. Said casing CS further comprises a drive unit flange DRF, wherein said drive unit DRU comprises a fixation flange FF, wherein said drive unit flange DRF and said fixation flange FF are fixedly connected to each other by fixation elements FE, wherein said drive unit DRU is exclusively supported by said fixation flange FF.

Figure 2:
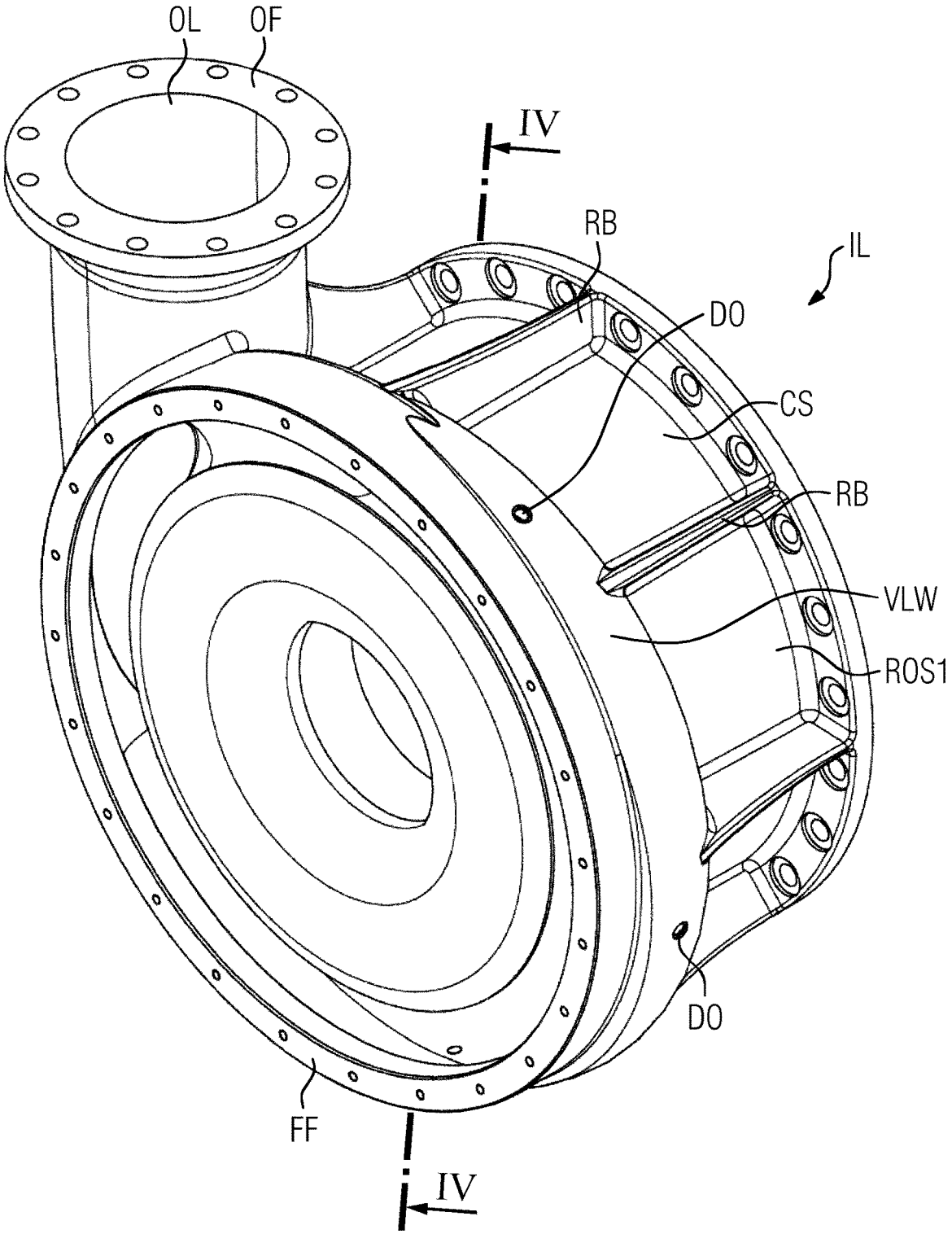
FIGS. 2 and 3 respectively show a schematic 3-dimensional depiction of a casing of a turbo compressor according to the invention.
Figure 3:
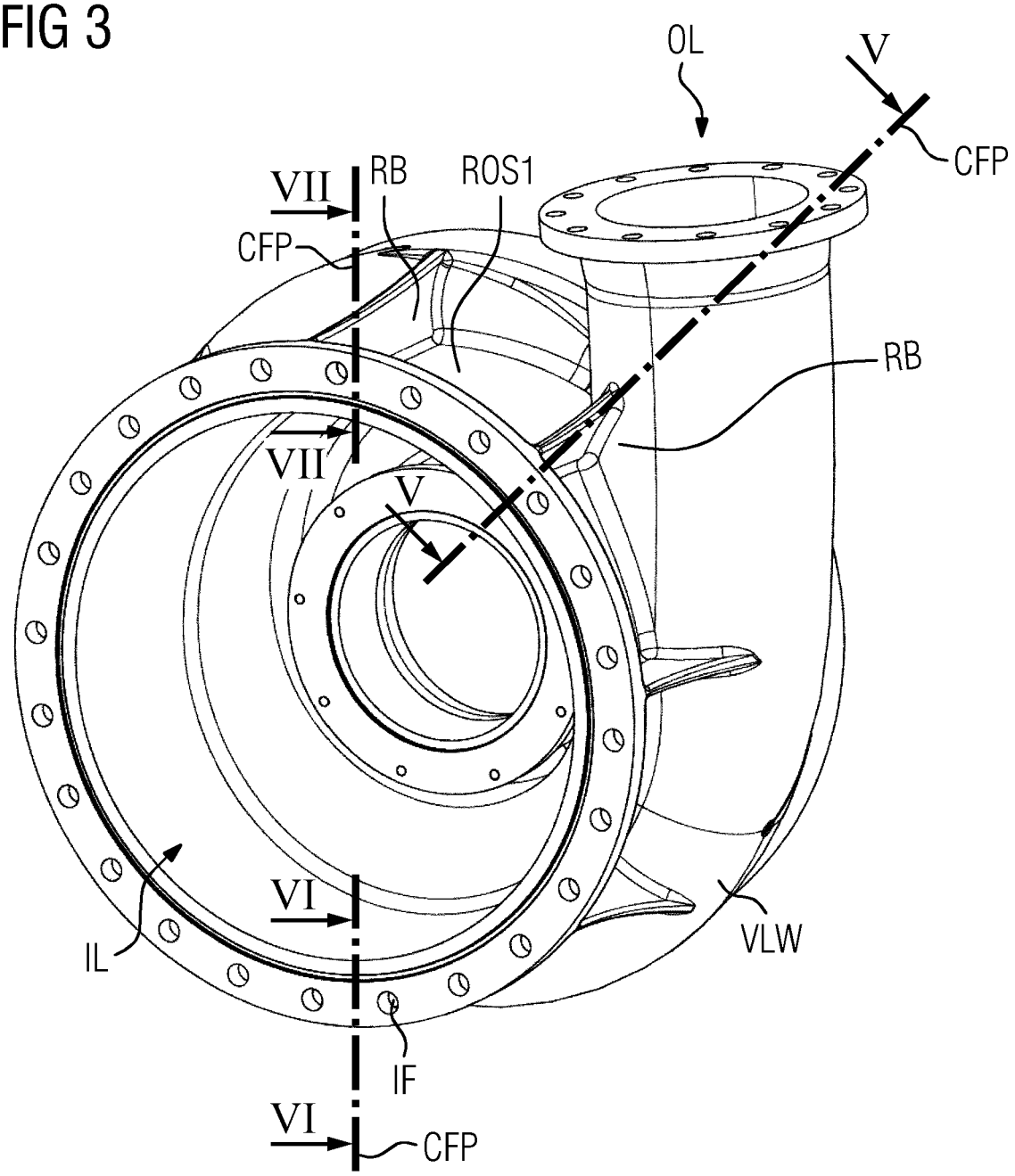
Figure 4:
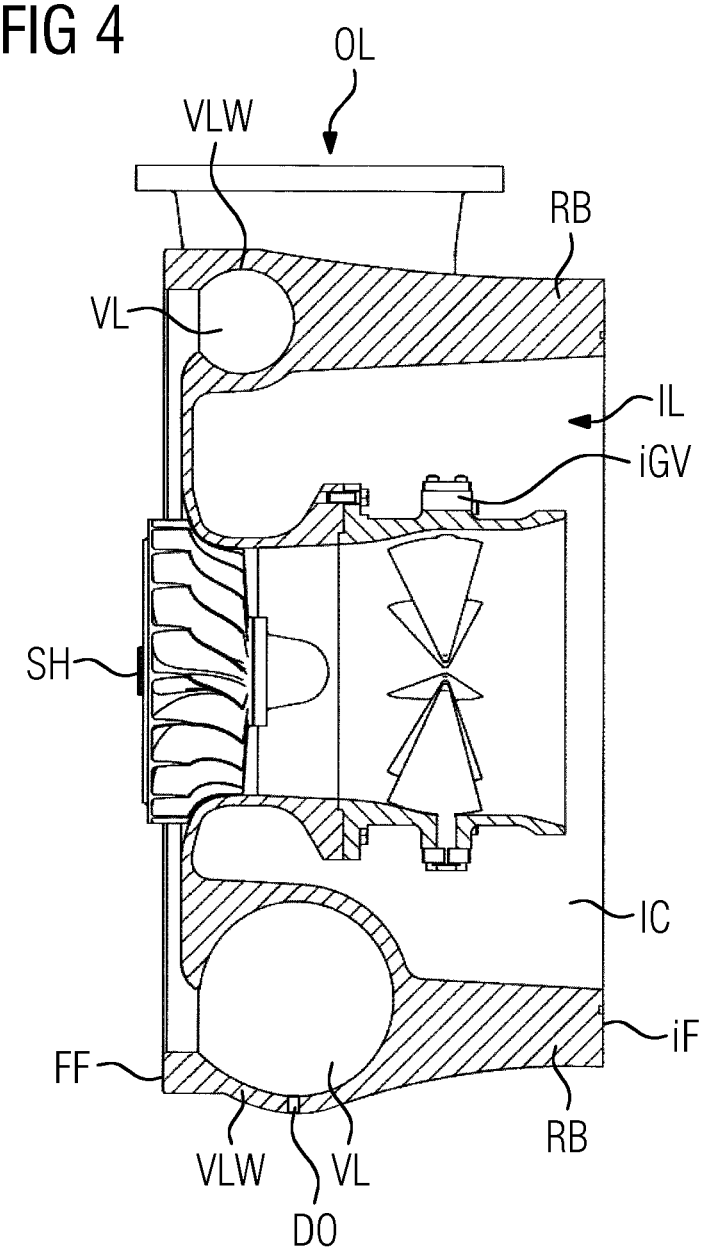
FIG. 4 shows a schematic section according to section IV in FIG. 2.
Figure 5:
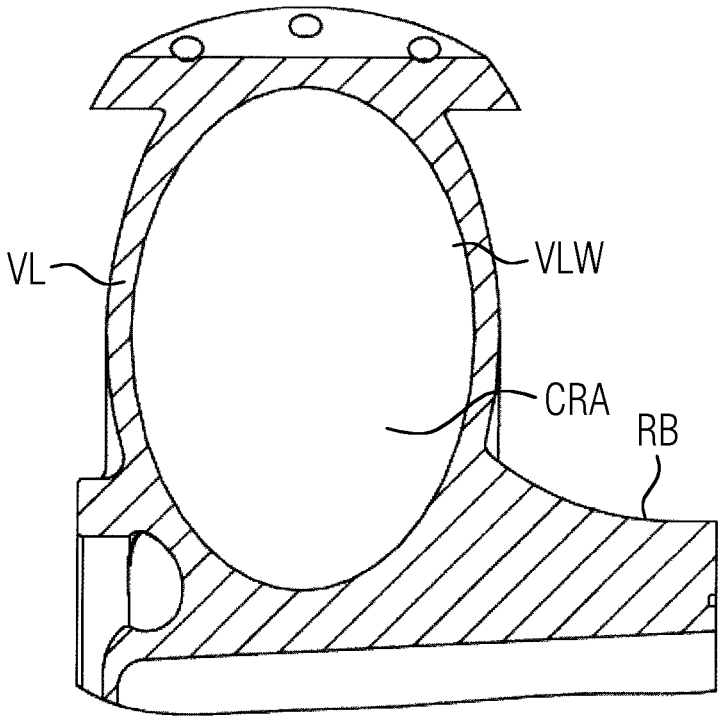
FIGS. 5-7 respectively show cross sections through ribs referring to section X, XI, XII indicated in FIG. 3.
Figure 6:
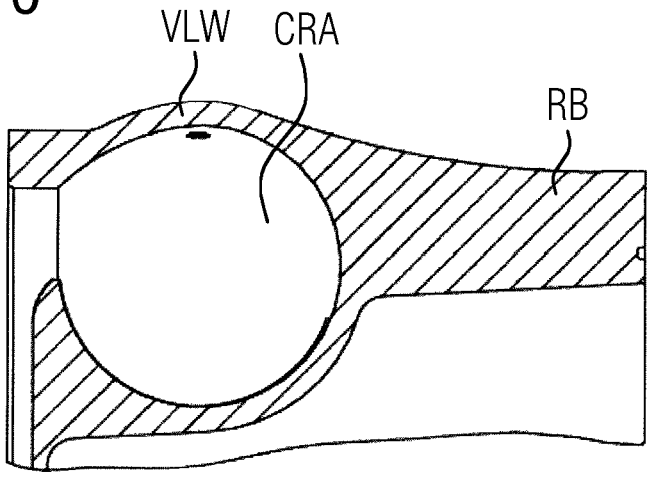
Figure 7:
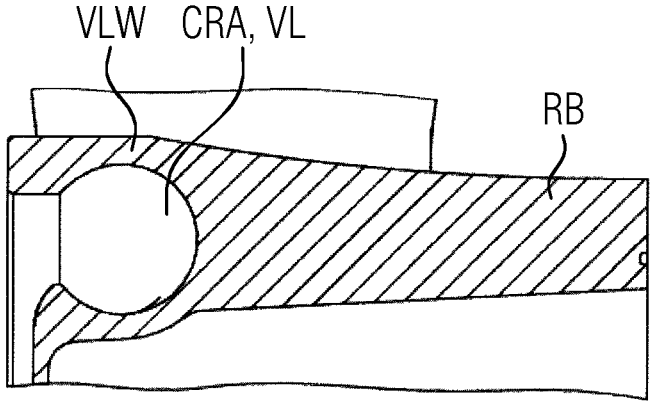

FIGS. 2, 3 and 4 respectively show the casing CS schematically and an axial portion of a shaft SH supporting the impeller IP (only FIG. 4). The turbo compressor TCO receives the process gas respectively exhaust gas EG axially through an inlet IL defined by an inlet flange IF. The impeller IP accelerates the exhaust gas EG and ejects the exhaust gas EG radially into an outlet volute VL. The circumferentially extending outlet volute VL collects the exhaust gas EG and decelerated the exhaust gas EG increasing pressure. Downstream the exhaust gas EG leaves the volute VL through an outlet OL defined by an outlet flange OF. Upstream of the impeller IP and downstream of the inlet flange IF the casing SC comprises an inlet chamber IC which is shaped as a volute. In the inlet chamber IC an inlet guide vane apparatus IGV (only FIG. 4) is provided to control the flow. The inlet chamber is defined by an inner surface which is sloped to enable drainage of any liquid in an axial direction. The volute VL of the outlet OL also comprises drain openings DO to drain any liquids carried with the exhaust gas EG. Along the circumference CD the casing CS is provided with several ribs RB extending from the inlet flange IF towards the fixation flange FF in an axial direction and extending radially along a rib's height. The radial outer part of the outer volute wall VLW is incorporated in each rib RB further stiffening the casing CS against bending. The outlet volute VL extends in circumferential direction CD and has at each circumferential position CFP a specific radial cross section area CRA, which is depicted for three different circumferential positions with ribs RB in FIG. 5, 6, 7. Said radial cross section area CRA is at least partly an integrated part of the respective rib RB at the specific circumferential position CFP. The basic radial outer contour of the casing CS omitting the ribs defines a circumferential radial outer first surface ROS1. This virtual cylindrical surface is defined by the outer contour of the casing SC at positions where the outer contour is not occupied by the ribs RB. This virtual cylindrical surface intersects at least along 50% of the circumference with the radial cross section area CRA.

The casing CS depicted in FIGS. 2, 3, 4 is casted in one piece comprising the inlet flange, the outlet flange, the outlet volute, the ribs, the radial outer first surface as far as it describes the contour.

The arrangement according to the invention is also suitable for being used in a method to retrofit an existing piston engine in order to improve the exhaust gas quality. In a first step of this method said recirculation line RL is provided. In a second step the turbo compressor TCO according to the invention is mounted to the recirculation line RL. This method is especially useful for retrofitting a piston engine PE as part of a vessel VS.

The invention claimed is:

1. An arrangement comprising a piston engine (PE), and comprising:

an exhaust gas line (EGL) for exhaust gas (EG);

a recirculation line (RL) conducting a portion of said exhaust gas (EG) into an inlet of said piston engine (PE);

wherein a radial turbo compressor (TCO) is provided in said recirculation line (RL), wherein the radial turbo compressor (TCO) comprises:

an impeller (IP);

a casing (CS);

wherein said impeller (IP) is rotatable about an axis (X), wherein said casing (CS) comprises an inlet (IL) upstream said impeller (IP), said inlet (IL) comprising an inlet flange (IF) to be mounted to a process gas pipe (PGP);

said casing (CS) comprising an outlet (OL) downstream of said impeller (IP) comprising an outlet flange (OF);

wherein said casing (CS) comprises an outlet volute (VL) extending about said axis (X) downstream of said impeller (IP) and upstream of said outlet (OL);

wherein said radial turbo compressor (TCO) comprises a drive unit (DRU) driving said impeller (IP) and being mounted to said casing (CS), wherein, when in use, said casing (CS) is exclusively supported by said inlet flange (IF) and said outlet flange (OF);

wherein said casing (CS) comprises a drive unit flange (DRF), wherein said drive unit (DRU) comprises a fixation flange (FF), wherein said drive unit flange (DRF) and said fixation flange (FF) are fixedly connected to each other by fixation elements (FE); and wherein said drive unit (DRU) is exclusively supported by said fixation flange (FF), wherein said casing (CS) comprises ribs (RB) in order to increase a bending stiffness of said casing (CS), said ribs (RB) distributed along a circumference of said casing extending axially at least partly between said drive unit flange (DRF) and said inlet flange (IF) and extending in radial direction along a rib's (RB) height.

2. The arrangement according to claim 1, wherein said outlet volute (VL) extending in circumferential direction (CD) has at each circumferential position (CFP) a specific radial cross section area (CRA) and wherein said radial cross section area (CRA) is at least partly an integrated part of the respective rib (RB) at a specific circumferential position (CFP).

3. The arrangement according to claim 1, wherein said casing (CS) comprises a circumferential radial outer first surface (ROS1), in an area which is not axially occupied by said outlet volute (VL) and not occupied by said ribs (RB), wherein said outlet volute (VL) radially extends at least along 50% of the circumference with its radial cross section area (CRA) in a same cylindrical plane as the radial outer first surface (ROS1).

4. The arrangement according to claim 1, wherein said casing (CS) is casted in one piece comprising inlet (IL), inlet flange (IF), an inlet chamber (IC), outlet (OL), outlet flange (OF), outlet volute (VL), ribs (RB), radial outer first surface (ROS1).

5. The arrangement according to claim 4, wherein said inlet chamber (IC) is located upstream of said impeller (IP) and downstream of said inlet flange (IF).

6. The arrangement according to claim 5, wherein said inlet chamber (IC) is shaped as a volute.

7. The arrangement according to claim 5, further comprising an inlet guide vane apparatus (IGV) disposed within said inlet chamber (IC).

8. The arrangement according to claim 4, wherein said inlet chamber (IC) and said outlet volute (OL) include a plurality of drain openings (DO) that are configured to drain any liquid carried with said exhaust gas (EG).

9. The arrangement according to claim 1, wherein said casing (CS) is supported by said inlet flange (IF) and said outlet flange (OF).

10. A radial turbo compressor (TCO) comprising:

an impeller (IP);

a casing (CS), wherein said impeller (IP) is rotatable about an axis (X), wherein said casing (CS) comprises an inlet (IL) upstream of said impeller (IP), said inlet (IL) comprising an inlet flange (IF) to be mounted to a process gas pipe (PGP);

wherein said casing (CS) comprises an outlet (OL) downstream said impeller (IP) comprising an outlet flange (OF);

wherein said casing (CS) comprises an outlet volute (VL) extending about said axis (X) downstream of said impeller (IP) and upstream of said outlet (OL);

wherein said radial turbo compressor (TCO) comprises a drive unit (DRU) driving said impeller (IP) and being mounted to said casing (CS), wherein, when in use, said casing (CS) is exclusively supported by said inlet flange (IF) and said outlet flange (OF);

wherein said casing (CS) comprises a drive unit flange (DRF), wherein said drive unit (DRU) comprises a fixation flange (FF), wherein said drive unit flange (DRF) and said fixation flange (FF) are fixedly connected to each other by fixation elements (FE); and wherein said drive unit (DRU) is exclusively supported by said fixation flange (FF), and wherein said casing (CS) comprises ribs (RB) in order to increase a bending stiffness of said casing (CS), said ribs (RB) distributed along a circumference of said casing extending axially at least partly between said drive unit flange (DRF) and said inlet flange (IF) and extending in radial direction along a rib's (RB) height.

11. The radial turbo compressor (TCO) according to claim 10, wherein said outlet volute (VL) extending in circumferential direction (CD) has, at each circumferential position (CFP), a specific radial cross section area (CRA) and wherein said radial cross section area (CRA) is at least partly an integrated part of the respective rib (RB) at a specific circumferential position (CFP).

12. The radial turbo compressor (TCO) according to claim 10, wherein said casing (CS) comprises a circumferential radial outer first surface (ROS1), in an area which is not axially occupied by said outlet volute (VL) and not occupied by said ribs (RB), wherein said outlet volute (VL) radially extends at least along 50% of the circumference with its radial cross section area (CRA) in a same cylindrical plane as the radial outer first surface (ROS1).

13. The radial turbo compressor (TCO) according to claim 10, wherein said casing (CS) is casted in one piece comprising inlet (IL), inlet flange (IF), an inlet chamber (IC), outlet (OL), outlet flange (OF), outlet volute (VL), ribs (RB), radial outer first surface (ROS1).

14. The radial turbo compressor (TCO) according to claim 10, wherein said casing (CS) is supported by said inlet flange (IF) and said outlet flange (OF).

15. The radial turbo compressor (TCO) according to claim 13, wherein said inlet chamber (IC) is located upstream of said impeller (IP) and downstream of said inlet flange (IF).

16. The radial turbo compressor (TCO) according to claim 15, wherein said inlet chamber (IC) is shaped as a volute.

17. The radial turbo compressor (TCO) according to claim 15, further comprising an inlet guide vane apparatus (IGV) disposed within said inlet chamber (IC).

18. The radial turbo compressor (TCO) according to claim 13, wherein said inlet chamber (IC) and said outlet volute (OL) include a plurality of drain openings (DO).

* * * * *